US005974696A

United States Patent [19]

Aird et al.

[11] Patent Number: 5,974,696

[45] Date of Patent: Nov. 2, 1999

[54] SKATE BOOT HAVING AN OUTSOLE WITH A RIGID INSERT

[75] Inventors: Frederic Aird, Ville Mont-Royal; Michel Laferriere, St-Jean, both of Canada

[73] Assignee: Sport Maska Inc., Quebec, Canada

[21] Appl. No.: 08/787,304

[22] Filed: Jan. 24, 1997

[51] Int. Cl.[6] ..... A43B 13/14; A43B 5/04; A43B 23/00

[52] U.S. Cl. ..... 36/31; 36/107; 36/115

[58] Field of Search ..... 36/30 R, 31, 131, 36/107, 108, 100, 113, 115, 117.3

[56] References Cited

U.S. PATENT DOCUMENTS

| | | | |
|---|---|---|---|
| 2,129,492 | 9/1938 | Dahlberg . | |
| 2,219,123 | 5/1940 | Wold . | |
| 3,373,511 | 3/1968 | Krapp . | |
| 3,526,976 | 9/1970 | Jacobs | 36/100 |
| 3,570,148 | 3/1971 | Morgan . | |
| 4,026,045 | 5/1977 | Druss | 36/107 |
| 4,351,120 | 9/1982 | Dalebout | 36/117.3 X |
| 4,353,173 | 10/1982 | Paquet . | |
| 4,580,359 | 4/1986 | Kurrash et al. . | |
| 4,651,445 | 3/1987 | Hannibal . | |
| 4,779,361 | 10/1988 | Kinsaul . | |
| 4,922,631 | 5/1990 | Anderie . | |
| 5,052,130 | 10/1991 | Barry et al. . | |
| 5,131,173 | 7/1992 | Anderié . | |
| 5,170,574 | 12/1992 | Weisbrich | 36/131 |
| 5,191,727 | 3/1993 | Barry et al. . | |
| 5,319,866 | 6/1994 | Foley et al. . | |
| 5,390,430 | 2/1995 | Fitchmun et al. . | |
| 5,404,723 | 4/1995 | Okajima . | |
| 5,437,466 | 8/1995 | Meibock et al. . | |
| 5,461,801 | 10/1995 | Anderton . | |
| 5,657,558 | 8/1997 | Pohu | 36/131 |
| 5,720,117 | 2/1998 | Toschi . | |

*Primary Examiner*—B. Dayoan
*Attorney, Agent, or Firm*—Factor and Shaftal

[57] ABSTRACT

An outsole including a base member, an insert member and a member for attaching a blade chassis to the insert member. The base member includes an outer surface, a ball region and a heel region. The insert member is integrally molded with at least a portion of the outer surface of the base member.

20 Claims, 2 Drawing Sheets

10
12
50
44
48
42
18
54
14
13
52
26
24
22
C
A 10
12
50
44
48
42
18
26
14
54
24
13
52
B

SKATE BOOT HAVING AN OUTSOLE WITH A RIGID INSERT

BACKGROUND OF THE INVENTION

1. Field of the Invention

The present invention is directed to skate boots for ice skating and inline skating, and, more specifically, to skate boots having an outsole with a rigid insert member which rigidifies the outsole, and aids in the direct transfer of energy from the skater to the blade chassis, and, in turn, the skating surface.

2. Background Art

Skate boots of the type attached to blade chassis for use with ice skates or inline skates are well known in the art. Generally, the blade chassis is attached to a rigid base member or sole. The sole is generally of a single planar material which extends from the toe and ball of the boot to the heel of the boot. The upper portion of the skate boot meets the sole and is attached thereto.

Such a construction has certain drawbacks. The skater, while able to transfer energy to the surface through the blade chassis, incurs significant energy losses. Not only does the foot of the skater move relative to the sole of the boot, but the blade chassis flexes relative to the sole. As a result of these movements, some of the energy generated by the skater is lost in these counterproductive movements and, in turn, some energy is not transferred to the blade chassis and the outside surface. The losses result in an overall loss of performance which is especially noticeable upon acceleration and turning or otherwise changing direction.

Other skate constructions have included vertical side panels with the sole. These side panels are integral with the sole, but extend upward along the boot a predetermined distance. While such prior art skates appear to limit the foot's movement (or sliding) relative to the sole, they do not prevent or limit the flexing and the bending of the sole relative to the blade chassis. Accordingly, with such constructions, a greater than negligible energy loss is nevertheless experienced, and, some of the energy imparted by the skater still does not reach the blade chassis and the surface.

Still other skate constructions have utilized a molded or machined unitized blade chassis and a sole out of a single piece of material. Inasmuch as the desired material properties for the sole and for the blade chassis are generally not the same, a unitary construction has inherent drawbacks. Additionally, for the same reasons, these skates are generally bulky, as the material from which they are constructed must be suitable for any and all regions of the blade carrier and the sole and the greatest stress that may be incurred by any region. As such, these skates, in certain instances, may lessen energy losses due to lost motion and flexing, however, any increased energy transfer over other skates, tends to be offset by greater bulk and compromise to comfort.

SUMMARY OF THE INVENTION

The skate boot comprises an outsole associated with the bottom of the skate boot, including a base member, at least one insert member and means for attaching a blade chassis to at least a portion of the insert member. The base member includes an outer surface, a ball region and a heel region. The insert member is attached to at least a portion of the outer surface of the base member, and is more rigid than the base member.

In a preferred embodiment, the insert member extends over at least a portion of one or both of the ball region and heel region of the base member. Preferably, the insert member comprises a first insert member that extends over at least a portion of the ball region, and a second insert member which extends over at least a portion of the heel region.

In another preferred embodiment, the insert member includes a thickness and the insert member is inserted in the base member a distance substantially equal to the thickness of the insert member.

Preferably, the base member comprises a first rigid layer and a second rigid layer. The first rigid layer extends substantially entirely from the ball region to the heel region. The second rigid layer overlays the first rigid layer and extends over a portion of one or both of the ball region and the heel region of the first rigid layer. The insert member is inserted within a portion of the second rigid layer. In such an embodiment, the second rigid layer may comprise a proximal second rigid layer extending over at least a portion of the ball region, and a distal second rigid layer extending over at least a portion of the heel region. In this embodiment, a first insert member is embedded within the proximal second rigid layer and a second insert member is embedded within the distal second rigid layer. Preferably, the proximal second rigid layer and the distal second rigid layer do not abut. Further, the second rigid layer may comprise a material with a greater rigidity than the first rigid layer.

Preferably, the insert member comprises a rigid composite including a fibrous material within a resin.

In another preferred embodiment, the outsole skate boot comprises an outsole which is associated with the bottom of the skate boot. The outsole includes a base member having an outer surface, a ball region, and a heel region, and, means for rigidifying the base member. The skate boot additionally includes means for attaching the blade chassis to the rigidifying means.

In such a preferred embodiment, the rigidifying means further comprises means for directly impacting energy to the blade chassis. The rigidifying means further comprises means for reducing losses associated with energy transfer to the blade chassis and may comprise an insert member which is attached to a portion of the outer surface of the base member.

In this preferred embodiment, the first insert member includes fibers that extend in parallel in a first diagonal direction, and, the second insert member includes fibers that extend in parallel and in a second diagonal direction opposite to the first diagonal direction.

The invention additionally comprises a method for manufacturing a skate boot, comprising the steps of: (a) fabricating at least one insert member of an outsole wherein the insert member is more rigid than the base member; (b) fabricating a base member of the outsole, where the base member includes an outer surface, a ball region and a heel region; (c) attaching the at least one insert member to the base member; (d) associating the outsole with the bottom of the skate boot; and (e) attaching a blade chassis to at least a portion of the at least one insert member.

In a preferred embodiment, the step of fabricating the base member may further comprise the step of introducing a base member material into a molding chamber wherein the base material is capable of adapting to the shape of the molding chamber. The method of attaching the insert member may comprise the step of positioning the insert member within the molding chamber prior to the step of fabricating the base member. In such an embodiment, the method may further comprise the step of applying an adhesive to the insert member prior to the step of introducing a base material, to promote integrated attachment therebetween.

In another preferred embodiment, where the base member includes a first rigid layer and a second rigid layer, the step of fabricating a base member of the outsole comprises the steps of: (a) fabricating the second rigid layer; (b) fabricating the first rigid layer; and (c) attaching the second rigid layer to the first rigid layer in overlaying attachment. The fabrication of the second rigid layer may comprise the steps of: (a) introducing a first base material into the molding chamber; and (b) allowing the first base material to set for a predetermined period of time. The step of fabricating the first rigid layer may comprise: (a) reconfiguring the mold chamber; (b) introducing a second base material into the molding chamber; and (c) allowing the second base material to set for a predetermined period of time. In this preferred embodiment, the method may further include the step of applying adhesive to the second rigid layer prior to the step of introducing the second base material.

In a preferred embodiment, the step of fabricating the at least one insert member comprises the fabrication of a composite material having a fiber and a resin composition.

DETAILED DESCRIPTION OF THE INVENTION

Figure 1:
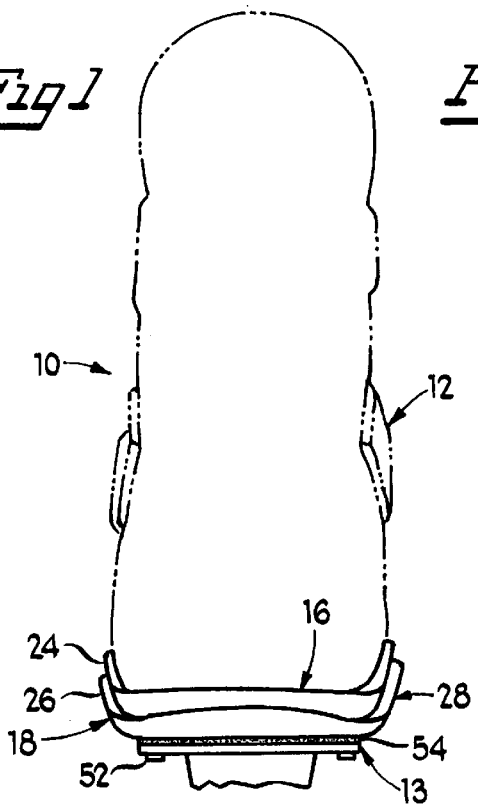
FIG. 1 of the drawings is a front elevational view of the skate boot, showing a partial attachment of the blade chassis.
Figure 2:
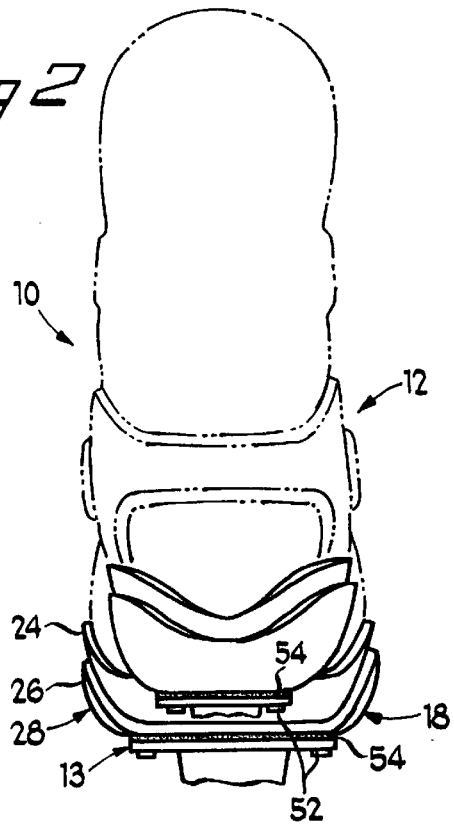
FIG. 2 of the drawings is a rear elevational view of the skate boot, showing a partial attachment of the blade chassis.
Figure 3:
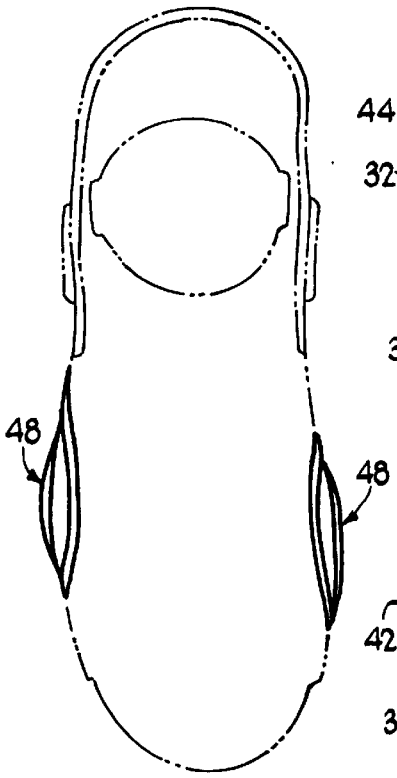
FIG. 3 of the drawings is a top plan view of the skate boot.

While the invention is susceptible of embodiment in many different forms, there is shown in the drawings, and will herein be described in detail, one specific embodiment, with the understanding that the present disclosure is to be considered as an exemplification of the principles of the invention and is not intended to limit the invention to the embodiment illustrated.

Figure 6:
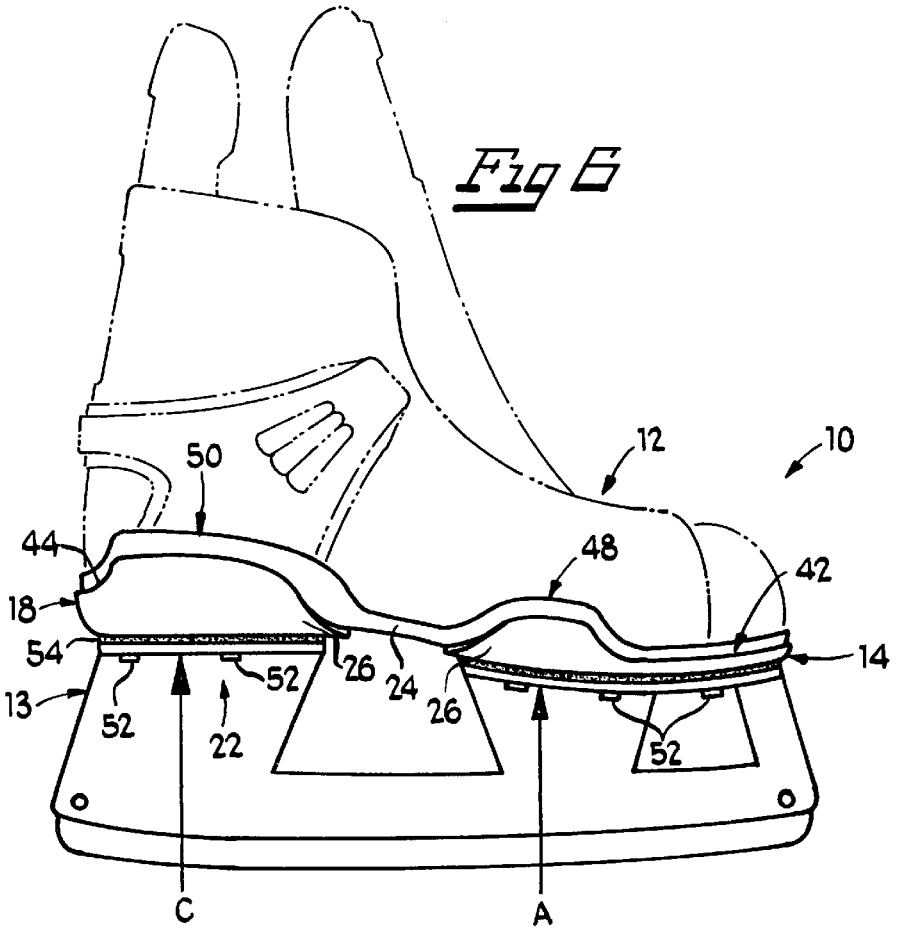
FIG. 6 of the drawings is a right side view of the skate boot, showing the blade chassis.
Figure 7:
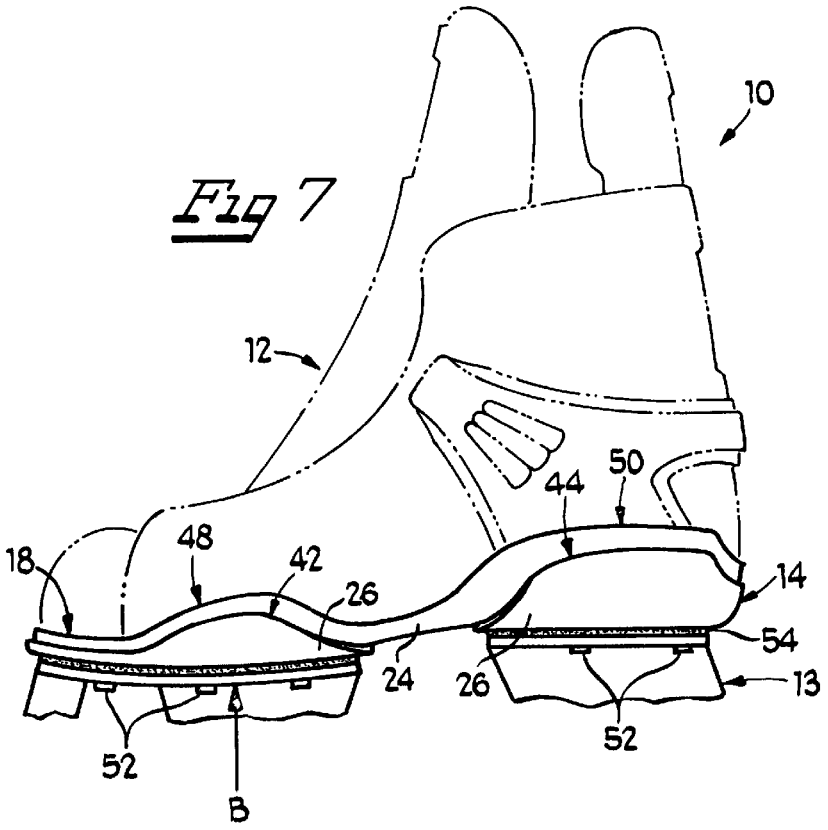
FIG. 7 of the drawings is a left side view of the skate boot, showing a portion of the blade chassis.

Skate boot 10 is shown in FIGS. 1, 2, 6 and 7 as comprising boot uppers 12, blade chassis 13 and outsole 14 (FIG. 6 and FIG. 7). Boot uppers 12 include boot bottom 16 (FIG. 1), and, may comprise a conventional skate boot commonly used for ice skating, ice hockey, street hockey and/or inline skating. Blade chassis 13 (FIG. 6) comprises the carrier for a figure, speed or hockey skate blade as well as, analogously, wheels of an inline skate, or a street hockey skate.

Outsole 14 is shown in FIGS. 4, 5, 6 and 7 as comprising base member 18, at least one insert member 20 and attachment means 22 (FIG. 6 and 7). Base member 18 comprises first rigid layer 24 and second rigid layer 26, and includes outer surface 28, ball region 30, arch region 31 and heel region 32. First rigid layer 24 (FIGS. 1, 2 and 4–7) extends from ball region 30 to heel region 32. Additionally, first rigid layer 24 may include front raised regions, such as front raised regions 48, as well as rear raised regions, such as rear raised region 50. These raised regions promote the overall stability of the skater and the rigidity of the skate boot, especially when the skater is turning, and aid in the transfer of energy from the skater to the blade chassis.

Second rigid layer 26 is show in FIGS. 4–7 as comprising proximal second rigid layer 42 and distal second rigid layer 44. Proximal second rigid layer 42 is overlayingly positioned relative to first rigid layer 24 proximate ball region 30, and, extends over substantially the entirety of ball region 30. Distal second rigid layer 44 is similarly overlayingly positioned relative to first rigid layer 24 proximate heel region 32, and, extends over substantially the entirety of heel region 30. Additionally, proximal second rigid layer 42 may extend over front raised regions, such as front raised region 48, and, distal second rigid layer 44 may extend over rear raised regions, such as rear raised region 50. It is also contemplated that second rigid layer be positioned over arch region 31.

First rigid layer 24 and second rigid layer 26 may comprise a polymer which is capable of being poured or otherwise molded into the desired shape. Second rigid layer 26 may comprise a polymer that is more rigid than first rigid layer 24. It is contemplated that first rigid layer 24 and second rigid layer 26 comprise machined components rather than molded components—although such molded components, as well as other material compositions are likewise contemplated. Further, it will be understood that the rigid layers may be integrated with each other, or, adhered together.

Figure 4:
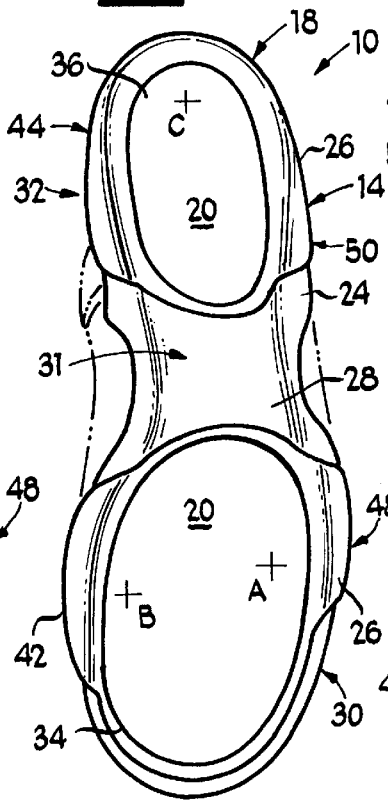
FIG. 4 of the drawings is a bottom plan view of the skate boot, having the blade chassis removed.
Figure 5:
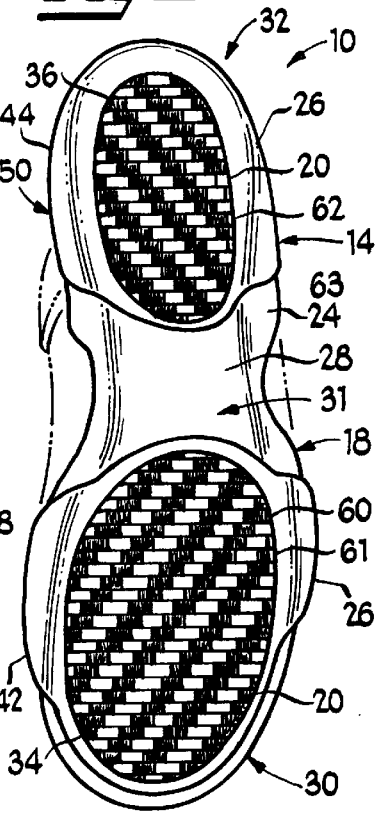
FIG. 5 of the drawings is a bottom plan view of the skate boot showing the use of a composite and having the blade chassis removed.

At least one insert member 20 is shown in FIGS. 4 and 5 as comprising first insert member 34 and second insert member 36—both of which may include a substantially uniform thickness. First insert member 34 and second insert member 36 are inserted into second rigid layer 26 a distance substantially equal to the thickness of the insert members. Accordingly, as shown in FIGS. 6 and 7, these insert members are substantially flush with the bottom of the second rigid layer. While other thicknesses are contemplated, the thickness of the composite is approximately 0.038 inches. Furthermore, in one preferred embodiment, the insert members are sized to substantially correspond to ball region 30 and to heel region 32, respectively; however, other configurations are also contemplated.

First insert member 34 and second insert member 36 are shown as comprising a composite material composed of a fibrous material impregnated and surrounded by a resin. Preferably, and as shown in FIG. 5, the fiber lines 60 and 62 comprise carbon fibers and fiber lines 61 and 63 comprise glass fibers. Additionally, it is contemplated that fiber lines 60 and 61 are parallel and inclined in the opposite direction from fiber lines 62 and 63, which are also parallel to each other. Although such a composite has been identified, other composite structures and other materials which are more rigid than base member 18 are likewise contemplated for use. As will be explained, such a rigid material will enhance skate performance by enabling a more direct transfer of energy from a wearer's foot to the skate blade, and, in turn, the skating surface with only a minimal amount of lost motion.

As shown in FIGS. 7 and 8, blade chassis 13 is secured to the insert members by attachment means 22, which may comprise a fastener 52 and conventional adhesive 54. Indeed, fastener 52 may comprise a rivet, screw, bolt or other conventional fastening means. In a preferred embodiment, fastener 52 extends through not only insert member 20 but through first rigid layer 24 and second rigid layer 26. Of course, other configurations for attachment are also contemplated.

The present invention also contemplates a unique method of manufacturing the previously described skates, and, more particularly, the insert member 18 associated with the bottom of the skate boot. At the outset, it should be noted that although a description of the fabrication of a skate boot with first and second rigid layers 24 and 26 will be described, it should be understood that the present invention can be manufactured with only one, or no rigid layer whatsoever. Furthermore, it is also to be understood that a single insert construction, as opposed to two separate inserts (as shown in FIG. 5) can be used—wherein the single (or other configuration) enables attachment of the skate chassis thereto.

Accordingly, to manufacture the skate boot, and with the above in mind, a series of steps are undertaken. First, at least one insert member 20 is fabricated to the appropriate desired size, such that it is capable of eventual integration with base member 18. As explained above, while other materials are contemplated, the insert member may comprise a composite composed of a fiber material and a resin. For example, the insert may be constructed with the following composition: the fibers may comprise 50% carbon fibers and 50% glass fibers, and, the resin may comprise a thermoplastic acrylic resin. Of course, other ratios as well as other fibers and resins are also contemplated.

Next, base member 18 of the outsole is fabricated. Such fabrication may comprise the addition of a base material (such as a polymer) into a molding chamber wherein the base material is capable of adapting to the surface contours of the molding chamber. The molding chamber is of a design known to those in the mold making art, however, it is specifically configured to render the desired shape of the base member, and, as will be explained, capable of positioning the insert members into the cavities in the base member.

To fabricate base member 18 (wherein base member 18 includes first rigid layer 24 and second rigid layer 26), at least one insert member 20 is positioned in a predetermined region in the molding chamber. An adhesive may be applied to the insert members prior to the introduction of the material which will comprise second rigid layer 26 to further promote a strong attachment. Next, the material which will comprise second rigid layer 26 is introduced into the molding chamber. Subsequently, the shape of the molding chamber is altered and material which will comprise the first rigid layer 24 is then introduced into the molding chamber. Although not required, an adhesive may be applied between the first and second rigid layers to increase the strength and to promote the bond therebetween. It is also contemplated that instead of the insert member being inserted into the molding chamber prior to molding of the second rigid layer, the at least one insert member may be adhered to second rigid layer 26 after the molding of the first and second rigid layers is complete, and, after the now formed base member has been removed from the molding chamber.

To complete the skate boot, the completed outsole, with inserts, is associated with the bottom of the boot via any combination of adhesive, stitching and/or riveting. The blade chassis is then mounted, through attachment means 22 to insert member 20 (See FIGS. 6 and 7).

In actual use, and for a better understanding of the benefits of the present invention, a skater wearing the previously described skate (and, more particularly, a skate having the previously described inserts) will experience more precise control and direct energy transfer between the foot, skate blade chassis and skating surface. Indeed, such a construction and utilization of the desired insert member has shown that as a skater imparts torsional forces on the skate blade (by, for example, quick altering of direction during skating), the insert members will serve to combat the effects thereof, and, in turn, limit torsional flexibility of the blade and chassis, relative to the boot, so as to impart a relatively high desired direct energy transfer from the skater's foot to the skating surface with few energy losses.

In support of such increased energy transfer, and, in turn, the benefits of, the present invention, several tests were conducted comparing the present skate boot (with insert members) to a conventional skate boot outsole. In each of the tests, a conventional blade chassis was attached to the bottom of the particular skate boot. The blade chassis was then secured in a three point bend bench; a common testing machine, one of such machines is made by the Lloyds Company. Once secured within the bench, compressive loads were applied at a controlled cross-head speed of 1 inch per minute until a cross-head displacement of 5 millimeters was reached. The test was repeated three times with load applied to each of points A, B and C, which are shown in FIGS. 4, 6 and 7. The three pressure points A, B and C are considered to be a center of an area where the loads applied by a skater are the highest. A computer acquisition system associated with the bench recorded torsional force and displacement. From these values, stiffness was calculated. The stiffer the outsole, the better the energy transfer from the skater to the blade chassis, and, in turn to the surface.

The results are shown in Table 1, hereinbelow:

TABLE 1

| Pressure Point | Skate Boot Having An Outsole According To The Invention Stiffness (N/Mm) | Skate Boot Having An Outsole According To The Invention Energy Loss (Joules) | Skate Boot Having A Conventional Outsole (Sport Maska 752 Sole) Stiffness (N/Mm) | Skate Boot Having A Conventional Outsole (Sport Maska 752 Sole) Energy Loss (Joules) | Difference Stiffness (%) | Difference Energy Loss (%) |
|---|---|---|---|---|---|---|
| A | 203 | 0.62 | 179 | 0.70 | +13 | −12 |
| B | 189 | 0.66 | 95 | 1.31 | +98 | −50 |
| C | 303 | 0.41 | 314 | 0.4 | −4 | 4 |

As show in the Table 1, above, at point A, the outsole of the present invention was calculated to be 13 percent stiffer than the conventional outsole. This stiffness translates into 12 percent less energy loss as compared to the conventional skate outsole. At point B, the outsole of the present invention was calculated to be 98 percent stiffer than the conventional skate outsole. This stiffness translates into 50 percent less energy loss compared to the conventional skate outsole. At point C, the outsole of the present invention was calculated to be 4 percent less stiff than the conventional skate outsole. This translates into 4 percent more energy loss. While at point C the conventional skate outsole appears to be stiffer, this difference is quite small (energy loss of 0.41 Joules compared to energy loss of 0.40 Joules) and is negligible. As such, the skate boot according to the invention is shown to have a substantially greater overall stiffness than the conventional boot, and such stiffness results in an increased transfer of energy from the skater to the blade chassis, and in turn to the skating surface.

The foregoing description and drawings are merely to explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A skate boot comprising:

an outsole associated with the bottom of the skate boot;

the outsole including, a base member having an outer surface, a ball region and a heel region;

at least one insert member integrally molded to at least a portion of the outer surface of the base member, the at least one insert member being more rigid than the base member; and means for attaching a blade chassis to at least a portion of the at least one insert member.

2. The skate boot according to claim 1 wherein the at least one insert member extends over at least a portion of at least one of the ball region and the heel region of the base member.

3. The skate boot according to claim 1 wherein the at least one insert member comprises a first insert member extending over at least a portion of the ball region and a second insert member extending over at least a portion of the heel region of the base member.

4. The skate boot according to claim 1 wherein the at least one insert member includes a thickness, the at least one insert member being inserted into the base member a distance substantially equal to the thickness of the at least one insert member.

5. The skate boot according to claim 4 wherein the at least one insert member comprises a first insert member extending over at least a portion of the ball region of the base member and a second insert member extending over at least a portion of the heel region of the base member.

6. The skate boot according to claim 1 wherein:

the base member comprises a first rigid layer and a second rigid layer;

the first rigid layer extends from the ball region to the heel region;

the second rigid layer overlays the first rigid layer and extends over a portion of at least one of the ball region and the heel region of the first rigid layer; and the at least one insert member inserted within at least a portion of the second rigid layer.

7. The skate boot according to claim 6 wherein:

the second rigid layer comprises a proximal second rigid layer extending over at least a portion of the ball region, and a distal second rigid layer extending over at least a portion of the heel region; and the at least one insert member comprises a first insert member embedded within at least a portion of the proximal second rigid layer, and a second insert member embedded within at least a portion of the distal second rigid layer.

8. The skate boot according to claim 7 wherein:

the proximal second rigid layer and the distal second rigid layer do not abut.

9. The skate boot according to claim 8 wherein:

the first insert member includes fibers which extend in parallel in a first diagonal direction; and the second insert member includes fibers which extend in parallel in a second diagonal direction, opposite to the first diagonal direction.

10. The skate boot according to claim 6 wherein the second rigid layer comprises a material with a greater rigidity than the first rigid layer.

11. The skate boot according to claim 1 wherein:

the insert member comprises a rigid composite including a fibrous material within a resin.

12. A skate boot comprising:

an outsole associated with the bottom of the skate boot;

the outsole including, a base member having an outer surface, a ball region and a heel region;

means for rigidifying the base member wherein the rigidifying means is integrally molded with the base member; and means for attaching a blade chassis to the rigidifying means.

13. The skate boot according to claim 12 wherein the rigidifying means further comprises means for directly impacting energy to the blade chassis.

14. The skate boot according to claim 12 wherein the rigidifying means further comprises means for reducing losses associated with energy transfer to the blade chassis.

15. The skate boot according to claim 12 wherein the rigidifying means comprises at least one insert member attached to at least a portion of the outer surface of the base member, the at least one insert member being more rigid than the base member.

16. A skate boot comprising:

an outsole associated with the bottom of the skate boot;

the outsole including, a base member having an outer surface, a ball region and a heel region;

the base member comprises a first rigid layer and a second rigid layer;

the first rigid layer extends from the ball region to the heel region;

the second rigid layer overlays the first rigid layer and extends over a portion of at least one of the ball region and the heel region of the first rigid layer; and the at least one insert member inserted within at least a portion of the second rigid layer;

at least one insert member attached to at least a portion of the outer surface of the base member, the at least one insert member being more rigid than the base member; and means for attaching a blade chassis to at least a portion of the at least one insert member.

17. The skate boot according to claim 16 wherein:

the second rigid layer comprises a proximal second rigid layer extending over at least a portion of the ball region, and a distal second rigid layer extending over at least a portion of the heel region; and the at least one insert member comprises a first insert member embedded within at least a portion of the proximal second rigid layer, and a second insert member embedded within at least a portion of the distal second rigid layer.

18. The skate boot according to claim 11 wherein:

the proximal second rigid layer and the distal second rigid layer do not abut.

19. The skate boot according to claim 18 wherein:

the first insert member includes fibers which extend in parallel in a first diagonal direction; and the second insert member includes fibers which extend in parallel in a second diagonal direction, opposite to the first diagonal direction.

20. The skate boot according to claim 16 wherein the second rigid layer comprises a material with a greater rigidity than the first rigid layer.

* * * * *